US006126009A

United States Patent [19]

Shiffler et al.

[11] Patent Number: 6,126,009

[45] Date of Patent: Oct. 3, 2000

[54] PORTABLE, SOFT PACK FACIAL TISSUE DISPENSING SYSTEM

[75] Inventors: Benjamin N. Shiffler, Racine; John L. Herzberg, Butte Des Morts; Cynthia W. Henderson, Neenah, all of Wis.

[73] Assignee: Kimberly-Clark Worldwide, Inc., Neenah, Wis.

[21] Appl. No.: 09/221,719

[22] Filed: Dec. 29, 1998

Related U.S. Application Data

[60] Provisional application No. 60/070,077, Dec. 31, 1997.

[51] Int. Cl.[7] ..... B65D 73/00

[52] U.S. Cl. ..... 206/494; 206/233; 206/812; 221/64; 383/85; 383/89

[58] Field of Search ..... 206/494, 233, 206/812, 449; 150/132; 221/33, 45, 47, 48, 49, 64; 383/84, 85, 86, 88, 89, 14, 62

[56] References Cited

U.S. PATENT DOCUMENTS

| | | | |
|---|---|---|---|
| D. 295,832 | 5/1988 | Shelton . | |
| 1,028,084 | 5/1912 | Bond . | |
| 1,228,251 | 5/1917 | Smith | 150/132 |
| 1,518,628 | 12/1924 | Wood . | |
| 1,669,064 | 5/1928 | Minetti | 150/132 |
| 1,706,166 | 3/1929 | Hunt . | |
| 1,747,601 | 2/1930 | Reps et al. . | |
| 1,982,616 | 11/1934 | Medoff . | |
| 2,033,621 | 3/1936 | Freedman . | |
| 2,093,724 | 9/1937 | Horwitt . | |
| 2,118,472 | 5/1938 | Morris . | |
| 2,125,618 | 8/1938 | Nystrand . | |
| 2,138,425 | 11/1938 | Morris . | |
| 2,195,622 | 4/1940 | Fourness et al. . | |
| 2,348,041 | 5/1944 | Warner . | |
| 2,473,932 | 6/1949 | Wolf . | |
| 2,529,853 | 11/1950 | Taggart . | |
| 2,559,528 | 7/1951 | Barrett . | |
| 2,574,345 | 11/1951 | Montgomery . | |
| 2,611,482 | 9/1952 | Nelson . | |

(List continued on next page.)

FOREIGN PATENT DOCUMENTS

| | | |
|---|---|---|
| 282833 | 11/1968 | Australia . |
| 3100286 A1 | 1/1982 | Austria . |
| 3437351 A1 | 4/1985 | Austria . |
| 470433 | 1/1951 | Canada . |
| 1151121 | 8/1983 | Canada . |
| 2003256 | 5/1990 | Canada . |
| 1321175 | 8/1993 | Canada . |
| 2334584 | 12/1982 | France . |
| 3324490 C1 | 11/1984 | Germany . |
| 3542999 A1 | 8/1986 | Germany . |
| 3514943 A1 | 10/1986 | Germany . |
| 0505675 A1 | 9/1992 | Germany . |
| 0119314 | 9/1984 | Japan . |
| 0179624 | 4/1986 | United Kingdom . |
| 2177376 | 1/1987 | United Kingdom . |
| WO 91/04920 | 4/1991 | WIPO . |

*Primary Examiner*—Paul T. Sewell
*Assistant Examiner*—Nhan T. Lam
*Attorney, Agent, or Firm*—Brinks Hofer Gilson & Lione

[57] ABSTRACT

This invention is directed to a facial tissue dispensing system which is a portable, flexible pack for dispensing tissues. The portable, flexible pack container is thin yet contains large tissues for cleaning when paper towels or rags are not available. Each of the large tissues is reversibly pre-folded three times onto itself in the lateral direction, and is not pre-folded in the longitudinal direction. The tissues are folded such that they unfold as they are being dispensed through the tissue dispensing opening of the container. After being placed into the portable, flexible pack container, the container is itself folded in half or folded in thirds ensuring the tissue dispensing opening on the top wall of the container is contained inside the fold or folds of the container. In this manner, tissues are kept clean and dry.

20 Claims, 6 Drawing Sheets

U.S. PATENT DOCUMENTS 2,621,788 12/1952 Hitchcock .
2,656,916 10/1953 Henderson .
2,761,584 9/1956 Johnson et al. .
2,768,739 10/1956 Gongolas .
2,826,230 3/1958 Conell ..... 206/494
2,861,735 11/1958 Faltin ..... 383/84
3,007,605 11/1961 Donovan .
3,012,692 12/1961 Petersen .
3,089,586 5/1963 Cole ..... 206/494
3,119,516 1/1964 Donovan .
3,198,228 8/1965 Naito .
3,369,700 2/1968 Nelson .
3,403,815 10/1968 Robson .
3,581,935 6/1971 Chi .
3,700,138 10/1972 Nelson .
3,747,802 7/1973 Uroshevich .
3,881,632 5/1975 Early et al. .
4,002,264 1/1977 Marchesani .
4,131,195 12/1978 Worrell, Sr. .
4,156,493 5/1979 Julius .
4,185,754 1/1980 Julius .
4,192,420 3/1980 Worrell, Sr. et al. .
4,231,491 11/1980 Pierson et al. .
4,252,238 2/1981 Spiegelberg et al. .
4,420,080 12/1983 Nakamura .
4,428,477 1/1984 Cristofolo .
4,460,088 7/1984 Rugenstein et al. .
4,540,091 9/1985 Haböck .
4,550,855 11/1985 Harrison .
4,552,269 11/1985 Chang .
4,570,820 2/1986 Murphy .
4,610,357 9/1986 Nakamura .
4,651,874 3/1987 Nakamura .
4,700,841 10/1987 Padgett, Jr. et al. .
4,709,399 11/1987 Sanders .
4,739,879 4/1988 Nakamura .
4,790,436 12/1988 Nakamura .
4,863,064 9/1989 Dailey, III .
4,877,154 10/1989 Matsui .
4,979,613 12/1990 McLaughlin et al. ..... 206/233
5,036,978 8/1991 Frank et al. .
5,040,685 8/1991 Focke et al. .
5,048,687 9/1991 Suzuki et al. .
5,048,718 9/1991 Nakamura .
5,065,868 11/1991 Cornelissen et al. .
5,076,424 12/1991 Nakamura .
5,076,465 12/1991 Lawson .
5,145,091 9/1992 Meyers .
5,152,121 10/1992 Nakamura .
5,161,350 11/1992 Nakamura .
5,165,545 11/1992 Focke et al. .
5,184,725 2/1993 Reinheimer et al. .
5,295,579 3/1994 Focke et al. .
5,328,053 7/1994 Cook et al. .
5,333,735 8/1994 Focke et al. .
5,356,032 10/1994 Rhodes .
5,361,936 11/1994 Cook .
5,363,986 11/1994 Cook .
5,377,837 1/1995 Roussel .
5,379,897 1/1995 Muckenfuhs et al. .
5,427,245 6/1995 Roussel .

FIG. 3
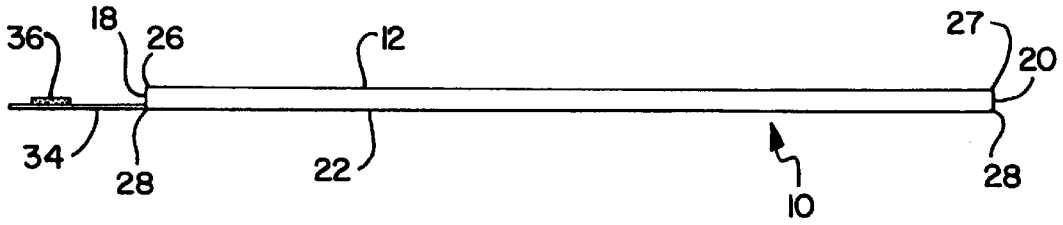
FIG. 4
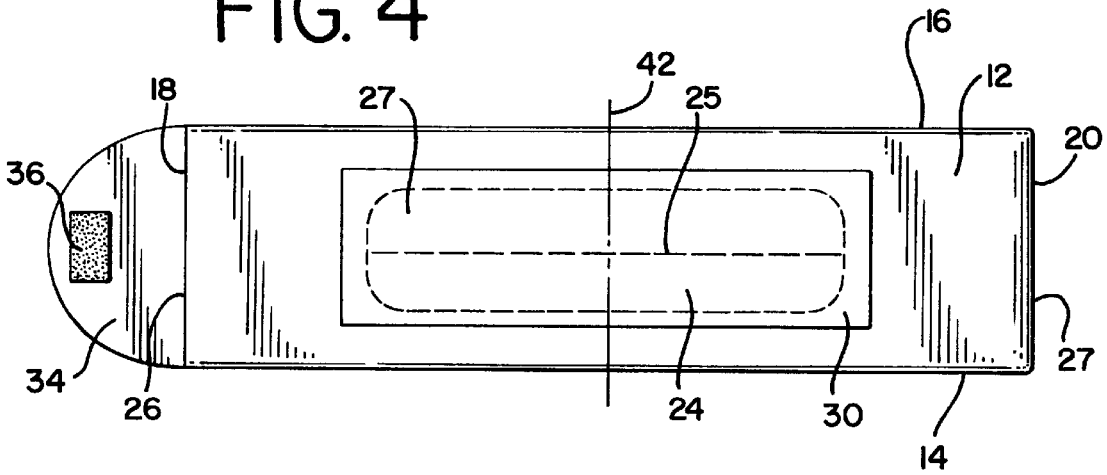
FIG. 5
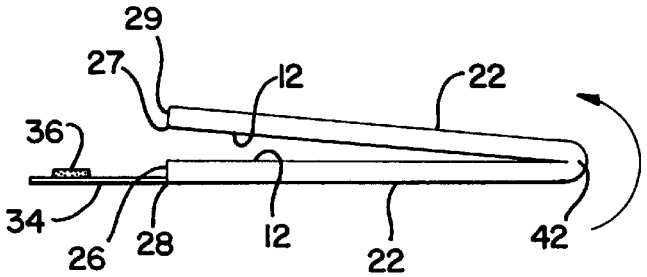
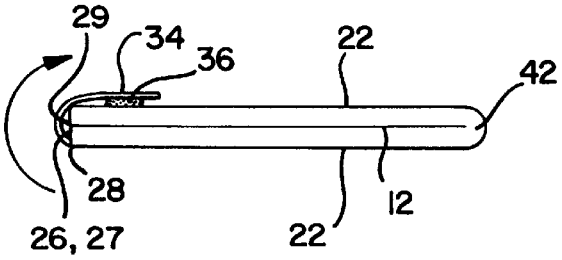
FIG. 6

FIG. 7
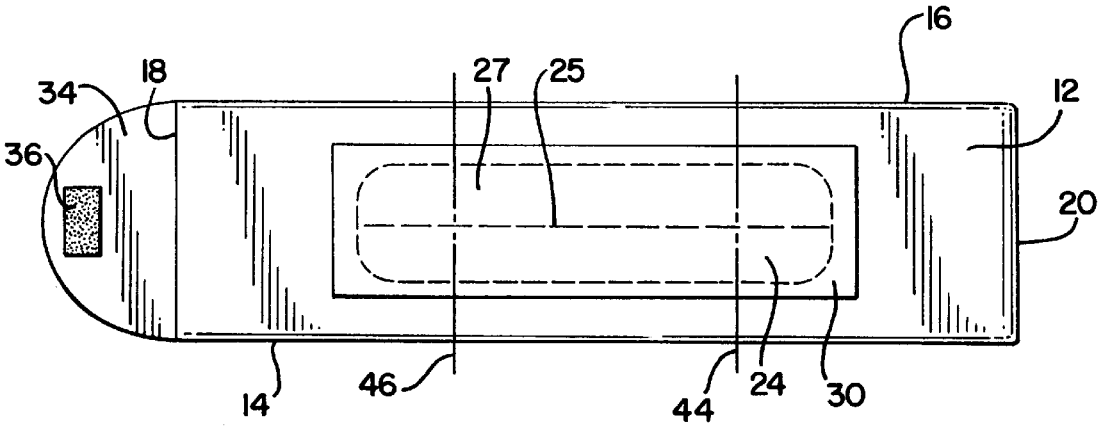
FIG. 8
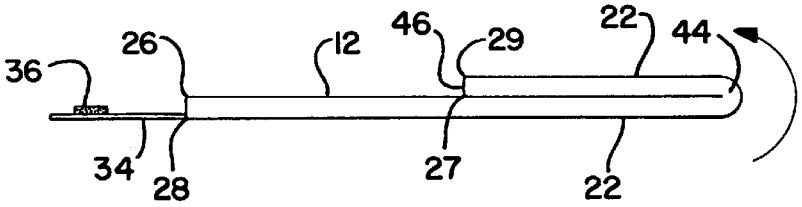
FIG. 9
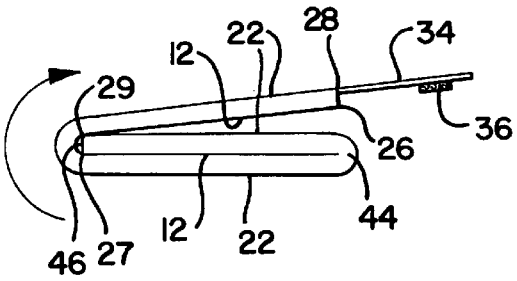
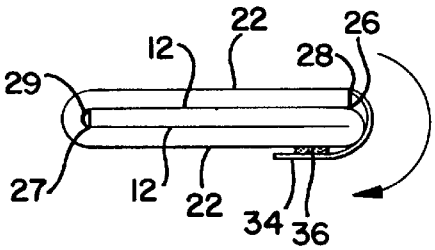
FIG. 10

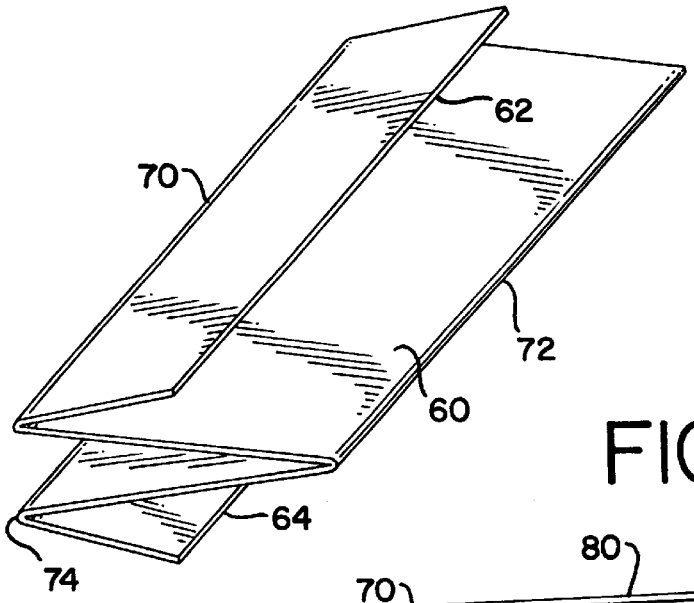
FIG. 15
FIG. 16
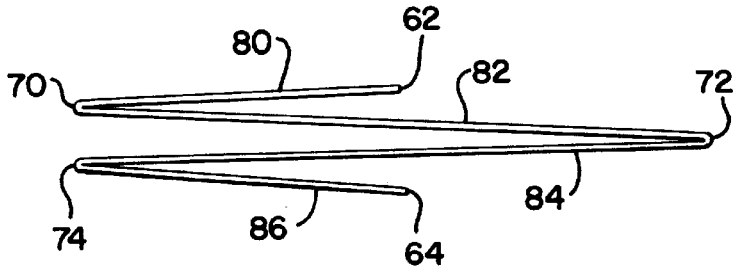

PORTABLE, SOFT PACK FACIAL TISSUE DISPENSING SYSTEM

RELATED APPLICATIONS

This application claims priority to U.S. Provisional Application No. 60/070,077, filed on Dec. 31, 1997 entitled "Portable Soft Pack Facial Tissue Dispensing System," the entire disclosure of the foregoing application is incorporated herein by reference.

FIELD OF THE INVENTION

This invention relates to a facial tissue dispensing system, and more particularly, to a facial tissue dispensing system which is portable and made of a soft material, such as a plastic film, for dispensing regular-sized or large-sized tissues, including moist or dry tissues.

BACKGROUND OF THE INVENTION

Facial tissues are well known in the art. The uses of facial tissues include, but are not limited to, blowing one's nose, cleaning one's glasses and other personal and household cleaning uses. Generally, a facial tissue dispensing system includes a stack of facial tissues placed within a container, usually a cardboard carton, or a plastic film package, commonly known as a pocket or portable pack.

The cartons are generally large in size. For example, a rectangular carton is generally about 9-⅜ inches in length by about 4¾ inches in height by 4¾ inches in width. These cartons are generally positioned by the user in a particular place in his or her home or office and left at that location. Thus, when the user desires a tissue, he or she must travel to the carton where it is located to dispense a tissue from the carton for his or her use.

On the other hand, portable packs are generally small in size. One example is about ⅞ inch in height by about 2¼ inches in width by about 4¼ inches in length. The portable packs are designed to travel with the user in his or her pocket, bag, purse or the like. Thus, when a user wants a tissue from a portable pack, he or she must merely reach into his or her pocket or purse to grab a tissue from the portable pack.

Various problems exist, however, with the current portable packs. One problem is that the portable pack may not be durable enough to withstand days or weeks in one's pocket or purse, the time usually required to use all of the tissues in a portable pack. A second problem may be that the closure device of the portable pack, which generally is a resealable opening, may not be durable enough to withstand repeated openings and closings, especially if the closure device is located at the same location as where the tissues are dispensed, i.e., the tissue dispensing opening. If the closure device is located at the tissue dispensing opening, the repeated and frequent act of pulling or drawing tissues over the resealable opening distorts and stretches the closure device, thereby rendering the device useless at keeping the portable pack closed. Therefore, if the portable pack is not durable enough, tissues could become dirty and/or fall out of the portable pack. Tissues may also become dirty as they are pulled out of the portable pack if the closure device accumulates dirt and lint on its adhesive portion.

Another problem with current portable packs is that it may not be quick and easy to access a tissue due to the folding of tissues placed in the portable pack. Because of the small size of portable packs, tissues must be folded multiple times in order to contain several tissues in the small space.

However, because of the multiple folds, the user generally must unfold the tissue after dispensing it from the portable pack before being able to use the full-size tissue. This makes it difficult for the user to be able to use the full-size tissue quickly after dispensing it from the portable pack. Moreover, if the tissue needs to be used quickly, before the user has a chance to unfold it, the tissue may not be large enough to offer adequate protection. Another problem which results from the multiple folds is that the user may believe that the tissue is smaller than it actually is.

While portable packs are small in size, many of them are too bulky to be carried comfortably and discreetly in a user's pocket. For example, where the portable pack is about ⅞ inch in height, it is generally too bulky to be placed into one's pants pocket comfortably.

Because of the ability of the portable packs to travel, the range of uses of the facial tissues in a portable pack is greater than those kept in a carton in one location in a home or office. For a spill in one's home, a person can use a variety of materials to clean the spill, such as a facial tissue, a paper towel, a rag or the like. During travel, however, people generally do not have paper towels or rags contained in their purses or cars. Thus, facial tissues in the portable packs are used to clean a variety of spills and the like when paper towels and rags are not available. Current facial tissues in portable packs, however, may not be large enough to be effective in cleaning spills and the like when paper towels or rags are not available.

Accordingly, it would be desirable to provide a portable, flexible pack tissue dispensing system which is durable enough to be stored in one's pocket or purse for long periods of time and which is durable enough to withstand repeated openings and closings. Moreover, it would be desirable to provide a portable, flexible pack tissue dispensing system which contains large tissue sheets yet which is still small and discreet enough to be placed comfortably and easily into one's pocket or purse. In addition, it would be desirable to provide a portable, flexible soft pack tissue dispensing system where the tissues contained therein are large enough to be suitable for a wide variety of tasks, such as nose-blowing, as well as cleaning up spills, in the alternative to a paper towel or rag.

SUMMARY OF THE INVENTION

One aspect of the invention provides portable, flexible facial tissue dispensing system for dispensing tissues comprising a generally rectangular flat flexible container, a stack of individually folded tissues contained within the container, and a resealable container closure flap. The container includes a top wall and a bottom wall: The top wall includes an opening formed therein through which tissues are dispensed. The top wall and the bottom wall each have a first edge and a second edge opposite the first edge. Each tissue includes three fold lines such that the tissue is reversibly folded onto itself three times before being placed into the container. An edge of the uppermost tissue of the stack is provided at the tissue dispensing opening. The uppermost tissue unfolds from its folded position as the edge of the tissue is grasped and pulled through the opening. The resealable container closure flap is preferably attached to the first edge of the bottom wall. The container may be folded in half lengthwise such that the first edge of the top wall contacts the second edge of the top wall, and to close the container, the closure flap is folded around the first and second edges of the top wall and the bottom wall and is attached to the bottom wall. Alternatively, the container may be folded in thirds and the closure flap is folded around the first edges of the top wall and the bottom wall to be attached to the bottom wall to close the container. The tissues in the stack preferably have an area of about 72 to 144 square inches, or between about 100 and 144 square inches. The flexible container may preferably be comprised of a plastic film material. The system may further comprise a second resealable closure flap covering the tissue dispensing opening. The second closure flap is opened for dispensing tissues through the tissue dispensing opening and is releaseably sealed to the top wall for closure of the container when the container is not in use. The dispensing opening preferably comprises a slit. The container preferably comprises no less than three individual tissues and no more than ten individual tissues. Each of the tissues preferably has a first lateral edge, a second lateral edge opposite the first lateral edge, a first longitudinal edge, and a second longitudinal edge opposite the first longitudinal edge. The fold lines are preferably parallel to the first and second lateral edges.

Another aspect of the invention provides a method of operating a portable, flexible facial tissue dispensing system. A generally rectangular flat flexible container, and a stack of individually folded tissues contained within the container are provided. The container includes a top wall and a bottom wall. The top wall includes an opening formed therein through which tissues are dispensed. The top wall and the bottom wall each have a first edge and a second edge opposite the first edge. The container is adapted to be folded in half and/or into thirds. Each tissue of the stack includes three fold lines such that the tissue is reversibly folded onto itself three times before being placed into the container. An edge of the uppermost tissue of the stack is provided at the tissue dispensing opening. The uppermost tissue is unfolded as it is pulled through the dispensing opening. The method may further comprise a resealable container closure flap attached to the first edge of the bottom wall. The closure flap is folded around a folded container to secure the container in a closed position. The closure flap may be released to unfold the container. The method may further comprise a tissue closure flap over the dispensing opening. The tissue closure flap may be pulled back to dispense tissues.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 3 is a front view of the embodiment shown in FIG. 1,

FIG. 4 is a top plan view illustrating a fold line to allow the container to be folded in half;

FIGS. 5 and 6 are front views depicting the closure of the container along the fold line shown in FIG. 4;

FIG. 7 is a plan view illustrating two fold lines to allow the container to be folded in thirds;

FIGS. 8, 9 and 10 are front views depicting the closure of the container along the two fold lines shown in FIG. 7;

FIG. 15 is a perspective view of a tissue folded along the fold lines shown in FIG. 14; and FIG. 16 is a side view of the folded tissue shown in FIG. 15.

DETAILED DESCRIPTION OF THE PREFERRED EMBODIMENTS

Figure 1:
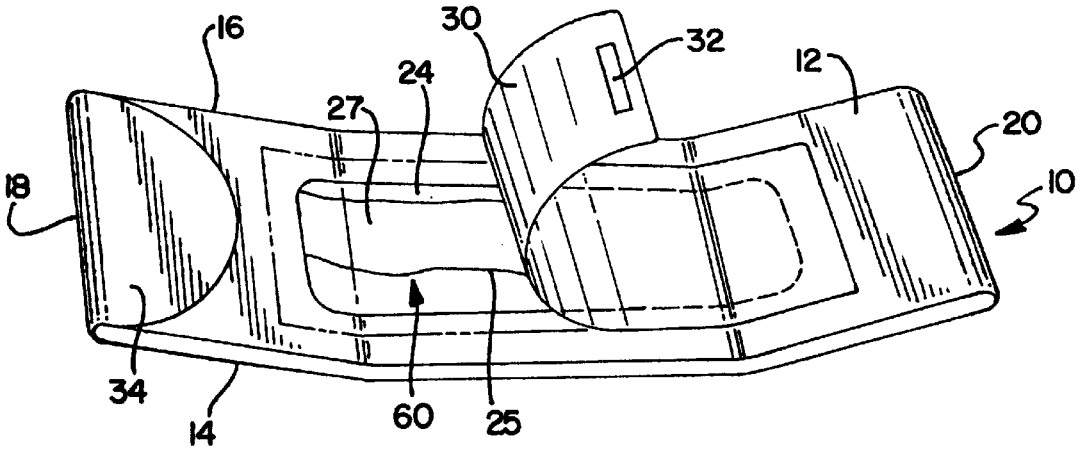
FIG. 1 is a perspective view of a preferred embodiment of the present invention.
Figure 2:
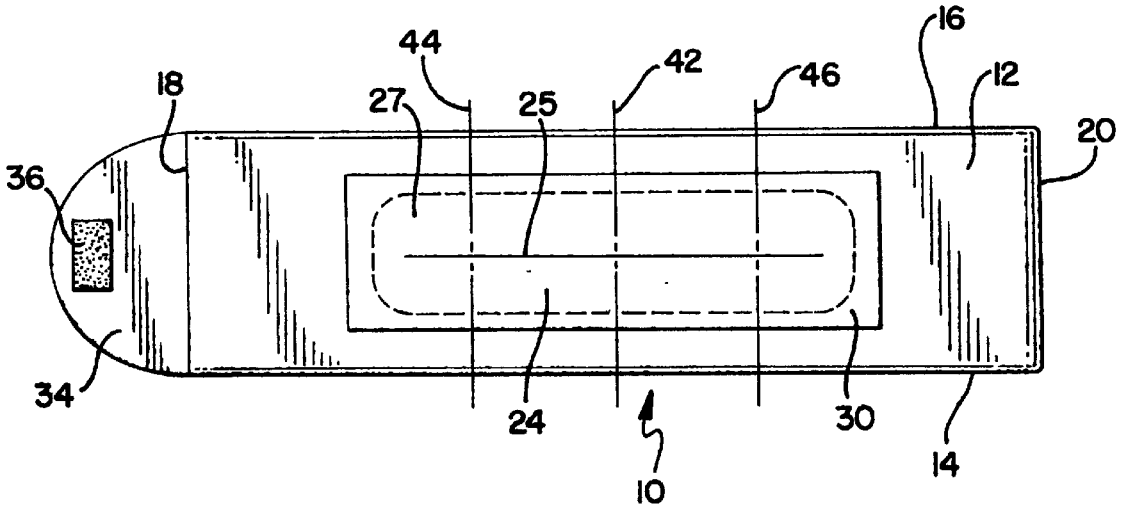
FIG. 2 is a top plan view of the embodiment shown in FIG. 1

FIGS. 1, 2 and 3 illustrate a preferred embodiment of the portable, flexible pack tissue dispensing system for dispensing regular or large-sized tissues of the present invention. Generally, the portable, flexible pack facial tissue dispensing system includes a thin, rectangular package or container 10, which has a top wall 12, side walls 14, 16, end walls 18, 20 and a bottom wall 22. In particular, the thin container 10 is generally about ⅛ to ¾ inch in height, about 3 inches in width and about 10 inches to about 12 inches in length.

The portable soft pack container 10, also contains an opening 24 on the top wall 12, wherein tissues 60 are dispensed through the opening 24. The tissue dispensing opening 24 may preferably, in the embodiment shown, be a rectangular shape. Alternatively, a slit-shaped opening or other non-rectangular-shaped opening may be used. The tissue dispensing opening 24 may be covered by a piece of plastic film 27. If so, a slit 25 may be preferably cut in the film to allow the tissues 60 to be dispensed through the slit 25. The size and position of the opening 24 and/or slit 25 is dependent upon the size of the tissues 60. The opening 24 and/or slit 25 is designed to facilitate ease in tissue removal and to keep the tissues clean until they are dispensed from the portable soft pack container 10.

The portable soft pack container 10 may also include a resealable closure device for the tissue opening. As shown in FIG. 1, the closure device may be a tissue closure flap 30, which is larger than the tissue dispensing opening 24, and which overlays or covers the tissue dispensing opening 24. Generally, the tissue closure flap 30 may utilize any variety of closure mechanisms. These closure mechanisms include, but are not limited to, using adhesives, cohesives and hook and loop closures. Thus, as shown in FIG. 1, adhesive 32 may be placed on the tissue closure flap 30 to adhere the tissue closure flap 30 to the top wall 12 of the container 10.

As shown in FIGS. 1–3, the portable soft pack container 10 includes a second closure flap 34 which closes the entire container 10. As shown in FIG. 3, the container closure flap 34 extends outward from one end of the bottom wall 22. To close the container 10 so that tissues 60 are protected from the environment, the container 10 is folded so that the tissue dispensing opening 24 and/or the slit 25 (either of which is located on the top wall 12) is located in the inside of the fold or folds of the container 10. In other words, the top wall 12 is folded onto itself such that the tissue dispensing opening 24 and/or slit 25 is contained within the fold(s) of the top wall 12.

Similar to the tissue closure flap 30, the container closure flap 34 may utilize any variety of closure mechanisms, such as, for example, adhesives, cohesives and hook and loop closures. In the embodiment illustrated in FIGS. 1–3, adhesive 36 is used to adhere the container closure flap 34 to the bottom wall 22. In any case, the closure mechanism on flap 34 is remote from opening 24. Alternatively, the container may be constructed without a closure flap, and the adhesive or other closure mechanisms may be positioned on the top and bottom walls of the container 10 to secure the folded container.

The container 10 may generally be bi-folded or tri-folded In one embodiment, as shown in FIGS. 4–6, the container 10 is bi-folded or, in other words, folded in half. FIG. 4 shows the top wall 12 of the container 10 and the fold line 42 for bi-folding. The fold line 42 is generally located at the middle of the top wall 12 so that the container 10 may be folded in half. In particular, as shown in FIG. 5, the container 10 is first folded in half about fold line 42 such that top wall 12 is folded upon itself. Then, as shown in FIG. 6, the container closure flap 34 is folded over and attached to the bottom wall 22.

More particularly, as shown most clearly in FIG. 3, the top wall 12 has a first edge 26 and a second edge 27. Similarly, the bottom wall 22 has a first edge 28 and a second edge 29. First edge 26 and first edge 28 are located on the same side wall of the container 10, in this case, side wall 18. Similarly, second edge 27 and second edge 29 are located on the same side wall of the container, here, side wall 20. Thus, when folding, as shown in FIG. 5, the top wall 12 is folded in half about fold line 42 such that the first edge 26 and the second edge 27 of the top wall 12 contact each other. Then, as shown in FIG. 6, the container closure flap 34 is folded over the edges 26, 27, 28, 29 of the top wall 12 and the bottom wall 22 preferably to be adhered by adhesive 36 to the bottom wall 22.

In a second embodiment, as shown in FIGS. 7–10, the container 10 is tri-folded or, in other words, folded in thirds. FIG. 7 illustrates the top wall 12 of the container 10 and the fold lines 44, 46 for tri-folding. The fold lines 44, 46 are generally located one-third and two-thirds, respectively, from each edge 26, 27 of the top wall 12 so that the container 10 may be folded in thirds. In particular, as shown in FIG. 8, the container 10 is first folded about fold line 44 such that the top wall 12 is folded part way onto itself. Then, as shown in FIG. 9, the container 10 is again folded about fold line 46 so that top wall 12 is folded over onto itself a second time. This time part of the top wall 12 contacts the bottom wall 22. Then, as shown in FIG. 10, the container closure flap 34 is folded over and attached to the bottom wall 22.

More particularly, in this embodiment, as shown in FIG. 8, the container 10 is folded such that the second edge 27 of the top wall 12 and the second edge 29 of the bottom wall 22 are located at one-third of the length of the container 10. Then, as shown in FIG. 9, the container 10 is folded such that the first edge 26 of the top wall 12 and the first edge 28 of the bottom wall 22 are located at one-third of the length of the container 10. Last, as illustrated in FIG. 10, the container closure flap 34 is then folded over the first edge 26 of the top wall 12 and the first edge 28 of the bottom wall 22 to preferably be adhered by adhesive 36 to the bottom wall 22.

The container 10 generally contains no fewer than three and no more than ten individual sheets of tissues 60. The tissues 60 are generally from about 72 square inches to about 144 square inches in area. Preferably, the tissues 60 are about 100 square inches to about 144 square inches in area. The tissues can be made in a variety of manners which are well known in the art. The tissues may be one-ply, or may be two or more plies. Moreover, the tissues may be dry or wet.

Before being placed into the container 10, the tissues 60 are individually folded such that an edge of the uppermost tissue of the stack of tissues 60 is provided and visible at the tissue dispensing opening 24 and/or slit 25 to provide a "handle" to pull the tissue from the container 10. In addition, the tissues 60 are folded such that each tissue unfolds as it is being removed from the container 10 and is thus immediately available for use by the user without any further unfolding of the tissue. Folding of the tissues before they are placed into the container 10 is known as "pre-folding."

Figure 12:
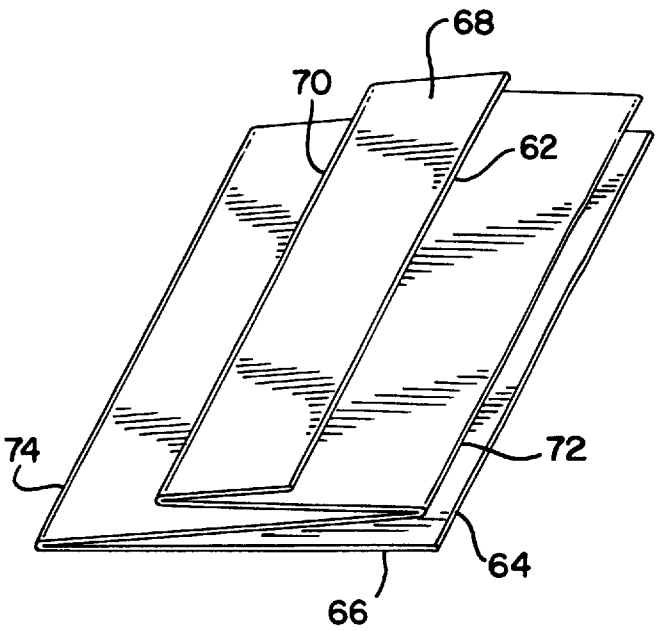
FIG. 12 is a perspective view of a tissue folded along the fold lines shown in FIG. 11.
Figure 11:
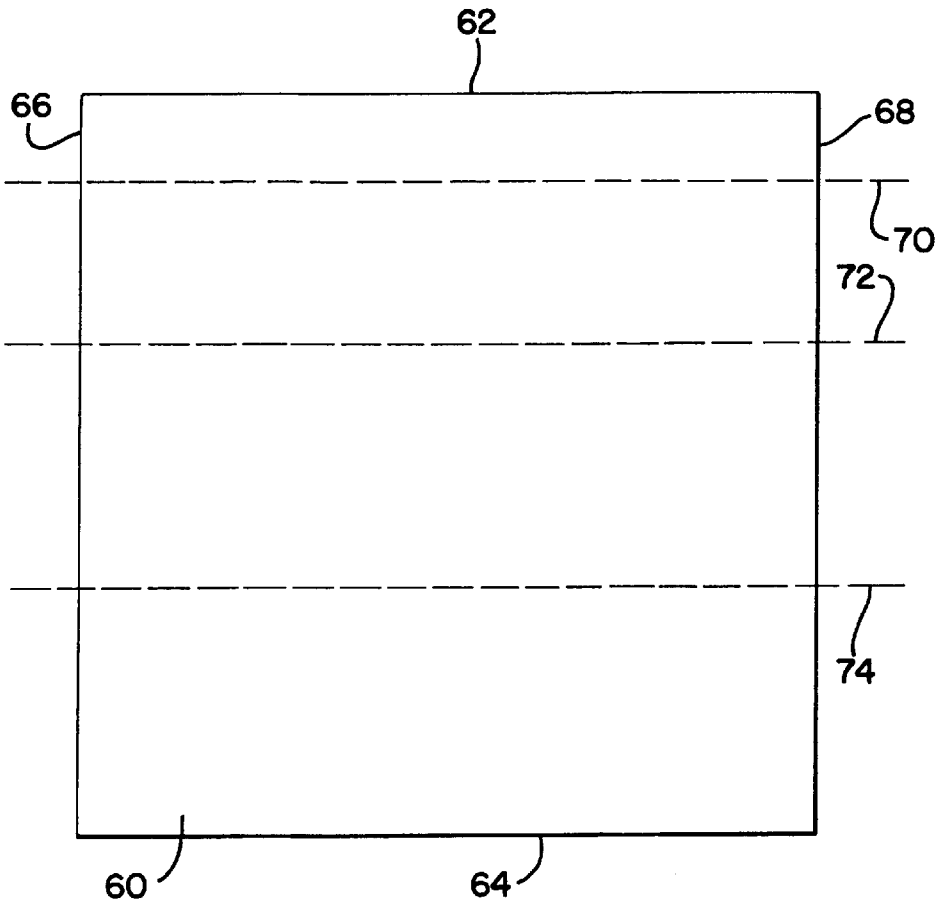
FIG. 11 is a top plan view of a preferred embodiment of a tissue of the present invention illustrating the fold lines of the tissue.
Figure 14:
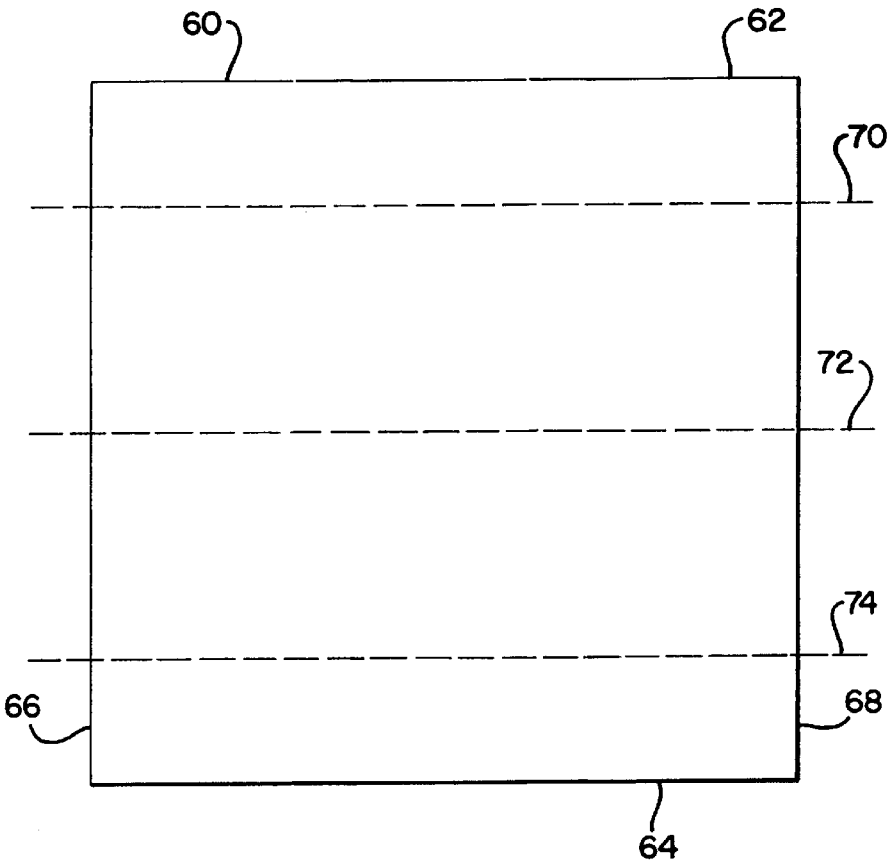
FIG. 14 is a plan view of a second embodiment of a tissue of the present invention illustrating the fold lines of the tissue.
Figure 13:
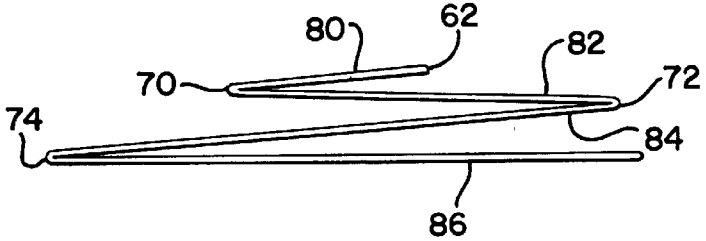
FIG. 13 is a side view of the folded tissue shown in FIG. 12.

Pre-folding of the tissues 60 is illustrated for one embodiment in FIGS. 11–13 and for a second embodiment in FIGS. 14–16. As shown in FIGS. 11 and 14, each tissues 60 has two lateral edges 62, 64, which are opposite each other and two longitudinal edges 66, 68, which are also opposite each other. For the folding of tissues 60 for the present invention, each tissues 60 has three fold lines 70, 72, 74, which are parallel to the lateral edges 62, 64, to reversibly fold a tissues 60 onto itself three times. Accordingly, the tissues 60 are preferably only folded in the lateral direction before being placed into the container.

Because the tissues 60 are preferably not folded in the longitudinal direction, the container 10 must be long enough to contain the tissues 60 which are full in length. While the tissues 60 are not pre-folded in the longitudinal direction before being placed into the container, the tissues 60 will be folded in the longitudinal direction when the container 10 is bi-folded or tri-folded, as discussed above.

Because each tissue 60 is folded onto itself three times, as shown in FIGS. 13 and 16, there are four layers of a tissues 60: the first layer 80, the second layer 82, the third layer 84, and the fourth layer 86. After the tissue 60 is reversibly and laterally folded onto itself three times, the tissue 60 is narrower in width to fit inside the container 10. In particular, the tissue 60 has a width which is equal to the width of the widest layer 80, 82, 84 or 86. In other words, the width of the multiple folded tissue 60 is the same distance as the longest distance between one of the following: (1) lateral edge 62 and fold line 70, (2) fold line 70 and fold line 72, (3) fold line 72 and fold line 74, or (4) fold line 74 and lateral edge 64.

After the tissues 60 are reversibly folded onto themselves into four layers 80, 82, 84, and 86, each tissue 60 has a height which is equal to four times the height of a single layer of tissue. Again, the tissues 60 are not pre-folded in the longitudinal direction.

Thus, in either of the embodiments shown in FIGS. 11–13 or FIGS. 14–16, the tissues 60 are individually folded such that the edge 62 of the tissues 60 will be provided and visible at the tissue dispensing opening 24 and/or slit 25 after the tissues 60 are placed into the container 10, thereby providing a "handle" to pull the tissues 60 from the portable soft pack container 10. Thus, when the user grabs the edge 62 of a tissue 60 and pulls the tissue 60 from the container 10, the tissue 60 unfolds, i.e., the tissue 60 straightens out, as it is being dispensed from the container 10 through the tissue dispensing opening 24 and/or slit 25. In other words, as the fold lines 70, 72, 74 of the tissue 60 pass through the tissue dispensing opening 24 and/or slit 25, each of the lines 70, 72, 74 flatten out, thereby forming a flat tissue 60. Therefore, after the user dispenses the tissue 60 fully from the container 10, the tissue is totally unfolded and is immediately available for use by the user.

The portable container 10 may preferably be made of a variety of flexible, plastic film materials, such as, for example, polyethylene, polypropylene or polyester. The plastic film material is preferably durable enough to withstand being stored in a pocket or purse for long periods of time. The film material is also preferably able to form a barrier between the tissues and the environment to keep the tissues clean and dry, while also being flexible, easy to process and cost-effective. The films may possess properties which enhance their ability to provide protection from moisture or other elements in the environment. The films may also be treated to retain moisture or scents or the like in the tissue itself which it is contained within the portable pack.

Of course, it should be understood that a wide range of changes and modifications can be made to the embodiments described above. It is therefore intended that the foregoing description illustrates rather than limits this invention, and that it is the following claims, including all equivalents, which define this invention.

We claim:

1. A portable, flexible facial tissue dispensing system for dispensing tissues comprising:

a generally rectangular, flat flexible container, including a top wall and a bottom wall, said top wall including an opening formed therein through which tissues are dispensed, said top wall and said bottom wall each having a first edge and a second edge opposite said first edge, a stack of individually folded tissues contained within said container, each tissue having a first lateral edge and a second lateral edge opposite said first lateral edge and having a first longitudinal edge and a second longitudinal edge opposite said first longitudinal edge, each tissue including three fold lines parallel to said first and second lateral edges such that each tissue is reversibly folded onto itself three times in the lateral direction before being placed into said container, wherein an edge of the uppermost tissue of said stack is provided at the tissue dispensing opening, wherein said uppermost tissue unfolds from its folded position as said edge of said tissue is grasped through said opening and pulled through said opening, a resealable container closure flap attached to said first edge of said bottom wall, and wherein said container is folded in half lengthwise such that said first edge of said top wall contacts said second edge of said top wall, wherein folding said container folds said tissues in the longitudinal direction and wherein said closure flap is folded around said first and second edges of said top wall and said bottom wall and is attached to said bottom wall to close said container.

2. The system of claim 1 wherein said tissues are about 72 square inches to about 144 square inches in area.

3. The system of claim 1 wherein said tissues are about 100 square inches to about 144 square inches in area.

4. The system of claim 1 wherein said flexible container is comprised of a plastic film material.

5. The system of claim 1 further comprising a second, resealable closure flap covering said tissue dispensing opening, wherein the second closure flap is opened for dispensing tissues through said tissue dispensing opening and said flap is releasably sealed to said top wall for closure of said container when the container is not in use.

6. The system of claim 1 wherein said dispensing opening comprises a slit.

7. The system of claim 1 wherein said container contains no less than three individual tissues and not more than ten individual tissues.

8. A portable, flexible facial tissue dispensing system for dispensing tissues comprising:

a generally rectangular, flat flexible container, including a top wall and a bottom wall, said top wall including an opening formed therein through which tissues are dispensed, said top wall and said bottom wall each having a first edge and a second edge opposite said first edge, a stack of individually folded tissues contained within said container, each tissue having a first lateral edge and a second lateral edge opposite said first lateral edge and having a first longitudinal edge and a second longitudinal edge opposite said first longitudinal edge, each tissue including three fold lines parallel to said first and second lateral edges such that each tissue is reversibly folded onto itself three times in the lateral direction before being placed into said container, wherein an edge of the uppermost tissue of said stack is provided at the tissue dispensing opening, wherein said uppermost tissue unfolds from its folded position as said edge of said tissue is grasped through said opening and pulled through said opening, a resealable container closure flap attached to said first edge of said bottom wall, and wherein said container is folded in thirds, wherein folding said container folds said tissues in the longitudinal direction and said closure flap is folded over to be attached to said bottom wall to close said container.

9. The system of claim 8 wherein said tissues are about 72 square inches to about 144 square inches in area.

10. The system of claim 8 wherein said tissues are about 100 square inches to about 144 square inches in area.

11. The system of claim 8 wherein said flexible container is comprised of a plastic film material.

12. The system of claim 8 further comprising a second, resealable closure flap covering said tissue dispensing opening, wherein the second closure flap is opened for dispensing tissues through said tissue dispensing opening and said flap is releasably sealed to said top wall for closure of said container when the container is not in use.

13. The system of claim 8 wherein said dispensing opening comprises a slit.

14. The portable, flexible facial tissue dispensing system for dispensing large tissues of claim 8 wherein said container contains no less than three individual tissues and not more than ten individual tissues.

15. A method of operating a portable and flexible facial tissue dispensing system comprising:

providing a generally rectangular, flat flexible container, including a top wall and a bottom wall, said top wall including an opening formed therein through which tissues are dispensed, said top wall and said bottom wall each having a first edge and a second edge opposite said first edge, providing a resealable container closure flap attached to the first edge of said bottom wall, providing a stack of individually folded tissues contained within said container, each tissue having a first lateral edge and a second lateral edge opposite said first lateral edge and having a first longitudinal edge and a second longitudinal edge opposite said first longitudinal edge, each tissue including three fold lines parallel to said first and second lateral edges such that the tissue is reversibly folded onto itself three times in the lateral direction before being placed into said container, wherein an edge of the uppermost tissue of said stack is provided at the tissue dispensing opening, folding said container at least one time, wherein said folding said container folds said tissues in the longitudinal direction, folding said closure flap around said folded container and securing said closure flap to said bottom wall to secure said container in a closed position, unfolding said container, and after unfolding said container, pulling the uppermost tissue through the dispensing opening, while unfolding the uppermost tissue.

16. The method of claim 15 further comprising releasing the closure flap prior to said unfolding the container.

17. The method of claim 18 further comprising:

providing a tissue closure flap over the dispensing opening; and pulling back the tissue closure flap prior to dispensing tissues.

18. The method of claim 17 wherein said container may be folded two times, thereby folding said container is thirds.

19. The method of claim 18 further comprising releasing the closure flap prior to said unfolding the container.

20. The method of claim 18 further comprising:

providing a tissue closure flap over the dispensing opening; and pulling back the tissue closure flap prior to dispensing tissues.

* * * * *

UNITED STATES PATENT AND TRADEMARK OFFICE

CERTIFICATE OF CORRECTION

PATENT NO. : 6,126,009
DATED : October 3, 2000
INVENTOR(S) : Benjamin N. Shiffler et al.

It is certified that error appears in the above-identified patent and that said Letters Patent is hereby corrected as shown below:

Claim 17,
Line 1, change "claim 18" to -- claim 15 --.

Claim 18,
Line 1, change "claim 17" to -- claim 15 --.
Line 2, change "container is" to -- container in --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*